US010794177B2

(12) United States Patent
Skinner et al.

(10) Patent No.: US 10,794,177 B2
(45) Date of Patent: Oct. 6, 2020

(54) MUD PUMP STROKE DETECTION USING DISTRIBUTED ACOUSTIC SENSING

(71) Applicant: Halliburton Energy Services, Inc., Houston, TX (US)

(72) Inventors: Neal Gregory Skinner, Lewisville, TX (US); Andreas Ellmauthaler, Rio de Janeiro (BR); Leonardo de Oliveira Nunes, Rio de Janeiro (BR); Christoper Lee Stokely, Houston, TX (US); David Andrew Barfoot, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 292 days.

(21) Appl. No.: 15/759,396

(22) PCT Filed: Oct. 29, 2015

(86) PCT No.: PCT/US2015/057949
§ 371 (c)(1),
(2) Date: Mar. 12, 2018

(87) PCT Pub. No.: WO2017/074374
PCT Pub. Date: May 4, 2017

(65) Prior Publication Data

US 2018/0252097 A1 Sep. 6, 2018

(51) Int. Cl.
*E21B 47/12* (2012.01)
*E21B 47/18* (2012.01)
(Continued)

(52) U.S. Cl.
CPC ..... *E21B 47/135* (2020.05); *E21B 47/18* (2013.01); *F04B 47/02* (2013.01); *F04B 47/04* (2013.01);
(Continued)

(58) Field of Classification Search
USPC ..... 73/168
See application file for complete search history.

(56) References Cited

U.S. PATENT DOCUMENTS 4,708,212 A 11/1987 McAuley et al.
5,150,333 A * 9/1992 Scherbatskoy ..... E21B 47/011 367/83
(Continued)

FOREIGN PATENT DOCUMENTS

WO 2013/090544 A1 6/2013
WO 2015/020645 A1 2/2015

OTHER PUBLICATIONS

Bush, Jeff, and Kwang Suh. "Fiber Fizeau interferometer for remote passive sensing." Fiber Optic Sensors and Applications IX. vol. 8370. International Society for Optics and Photonics, 2012.
(Continued)

*Primary Examiner* — Clayton E. LaBalle
*Assistant Examiner* — Warren K Fenwick
(74) *Attorney, Agent, or Firm* — John W. Wustenberg; Baker Botts L.L.P.

(57) ABSTRACT

An example system for detecting mud pump stroke information comprises a distributed acoustic sensing (DAS) data collection system coupled to a downhole drilling system, a stroke detector coupled to a mud pump of the downhole drilling system configured to detect strokes in the mud pump and to generate mud pump stroke information based on the detected strokes, and a fiber disturber coupled to the stroke detector and to optical fiber of the DAS data collection system configured to disturb the optical fiber based on mud pump stroke information generated by the stroke detector. The system further comprises a computing system comprising a processor, memory, and a pulse detection module operable to transmit optical signals into the optical fiber of the DAS data collection system, receive DAS data signals in
(Continued)

response to the transmitted optical signals, and detect mud pump stroke information in the received DAS data signals.

20 Claims, 6 Drawing Sheets

(51) Int. Cl.
*E21B 47/135* (2012.01)
*F04B 49/06* (2006.01)
*F04B 47/02* (2006.01)
*F04B 47/04* (2006.01)

(52) U.S. Cl.
CPC .... *F04B 49/065* (2013.01); *F04B 2201/0201* (2013.01); *F04B 2201/0209* (2013.01)

(56) References Cited

U.S. PATENT DOCUMENTS 5,182,730 A * 1/1993 Scherbatskoy ..... E21B 41/0085 367/43
5,812,068 A 9/1998 Wisler et al.
6,097,486 A 8/2000 Vakoc et al.
6,252,656 B1 6/2001 Wu et al.
7,172,038 B2 2/2007 Terry et al.
7,617,873 B2 11/2009 Lovell et al.
8,049,506 B2 11/2011 Lazarev
8,397,836 B2 3/2013 Pool et al.
8,408,064 B2 4/2013 Hartog et al.
8,610,896 B2 12/2013 Spross et al.
9,163,958 B2 * 10/2015 Zadok ..... H04B 10/071
9,719,846 B2 * 8/2017 Ellmauthaler ..... G01H 9/004
9,766,363 B2 * 9/2017 Morys ..... G01V 11/007
2002/0194932 A1 12/2002 Gysling et al.
2004/0256100 A1 12/2004 Tubel et al.
2007/0272406 A1 11/2007 McCoy et al.
2010/0200743 A1 8/2010 Forster et al.
2011/0111104 A1 5/2011 Thompson et al.
2012/0092960 A1 4/2012 Gaston et al.
2012/0111104 A1 * 5/2012 Taverner ..... G01H 9/004 73/152.16
2013/0011102 A1 * 1/2013 Rinzler ..... G02B 6/3813 385/89
2013/0169279 A1 * 7/2013 Morys ..... G01V 11/007 324/338
2014/0022530 A1 1/2014 Farhadiroushan et al.
2014/0126331 A1 5/2014 Skinner
2014/0219056 A1 8/2014 Samson et al.

OTHER PUBLICATIONS

Optiphase, Inc., Data Sheet for "TDI-7000 TDM Fiber Interrogator", Revision 3 dated Aug. 2013, 2 pages.
International Search Report and Written Opinion issued in related PCT Application No. PCT/US2015/057949 dated Jul. 26, 2016, 16 pages.
International Preliminary Report on Patentability in related PCT application No. PCT/US2015/057949 dated May 11, 2018, 12 pages.

* cited by examiner

MUD PUMP STROKE DETECTION USING DISTRIBUTED ACOUSTIC SENSING

CROSS-REFERENCE TO RELATED APPLICATION

The present application is a U.S. National Stage Application of International Application No. PCT/US2015/057949 filed Oct. 29, 2015, which is incorporated herein by reference in its entirety for all purposes.

BACKGROUND

This disclosure generally relates to the monitoring of hydrocarbon wellbores, and more particularly to detecting mud pulse signals and mud pump stroke information using Distributed Acoustic Sensing (DAS) techniques.

Drilling requires the acquisition of many disparate data streams, including mud pulse telemetry data. Mud may refer to drilling fluid used when drilling wellbores for hydrocarbon recovery. Mud may be pumped through the drill bit and the area surrounding the drill bit for cooling and lubrication, and then pumped through a mud conditioning system to clean the drilling fluid or to perform other operations. Drilling systems may use valves to modulate the flow of the mud, which may generate pressure pulses that propagate up the column of fluid inside the wellbore. The pressure pulses (referred to as mud pulses) may be analyzed to determine one or more properties or characteristics associated with the drilling operation. As it pumps the mud through the drilling system, a mud pump may generate additional pressure pulses (referred to as mud pump stroke pulses) that may interfere with the detection of the transmitted mud pulses.

Acoustic sensing using DAS may use the Rayleigh backscatter property of a fiber's optical core and may spatially detect disturbances that are distributed along the fiber length. Such systems may rely on detecting optical phase changes brought about by changes in strain along the fiber's core. Externally-generated acoustic disturbances may create very small strain changes to optical fibers.

BRIEF DESCRIPTION OF THE DRAWINGS

These drawings illustrate certain aspects of certain embodiments of the present disclosure. They should not be used to limit or define the disclosure.

While embodiments of this disclosure have been depicted and described and are defined by reference to example embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

The present disclosure describes a system and method for detecting transmitted mud pulse signals and mud pump stroke information using a DAS system. Mud pulse signals sent from downhole during drilling operations may have relatively low amplitude when detected at or near the surface of a well. In addition to these pressure pulses, a mud pump located at the surface of the well may generate relatively large amplitude pressure pulses (due to the reciprocation of the pump pistons and/or the opening and closing of intake and discharge valves in the pump). These additional pressure pulses from the mud pump may interfere with the detection of the transmitted mud pulse signals from downhole. In order to better detect the transmitted mud pulse signals, aspects of the present disclosure may include a DAS system coupled to various locations along the drill string, mud return tube, and/or the mud pump of the drilling system to detect disturbances in the optical fiber caused by the mud pulse signals and the mud pump strokes. Once detected by the DAS system, the mud pump stroke information may be removed from the DAS data to provide a cleaner mud pulse signal for analysis.

To facilitate a better understanding of the present disclosure, the following examples of certain embodiments are given. In no way should the following examples be read to limit, or define, the scope of the disclosure. Embodiments of the present disclosure and its advantages are best understood by referring to FIGS. 1 through 5, where like numbers are used to indicate like and corresponding parts.

Figure 1:
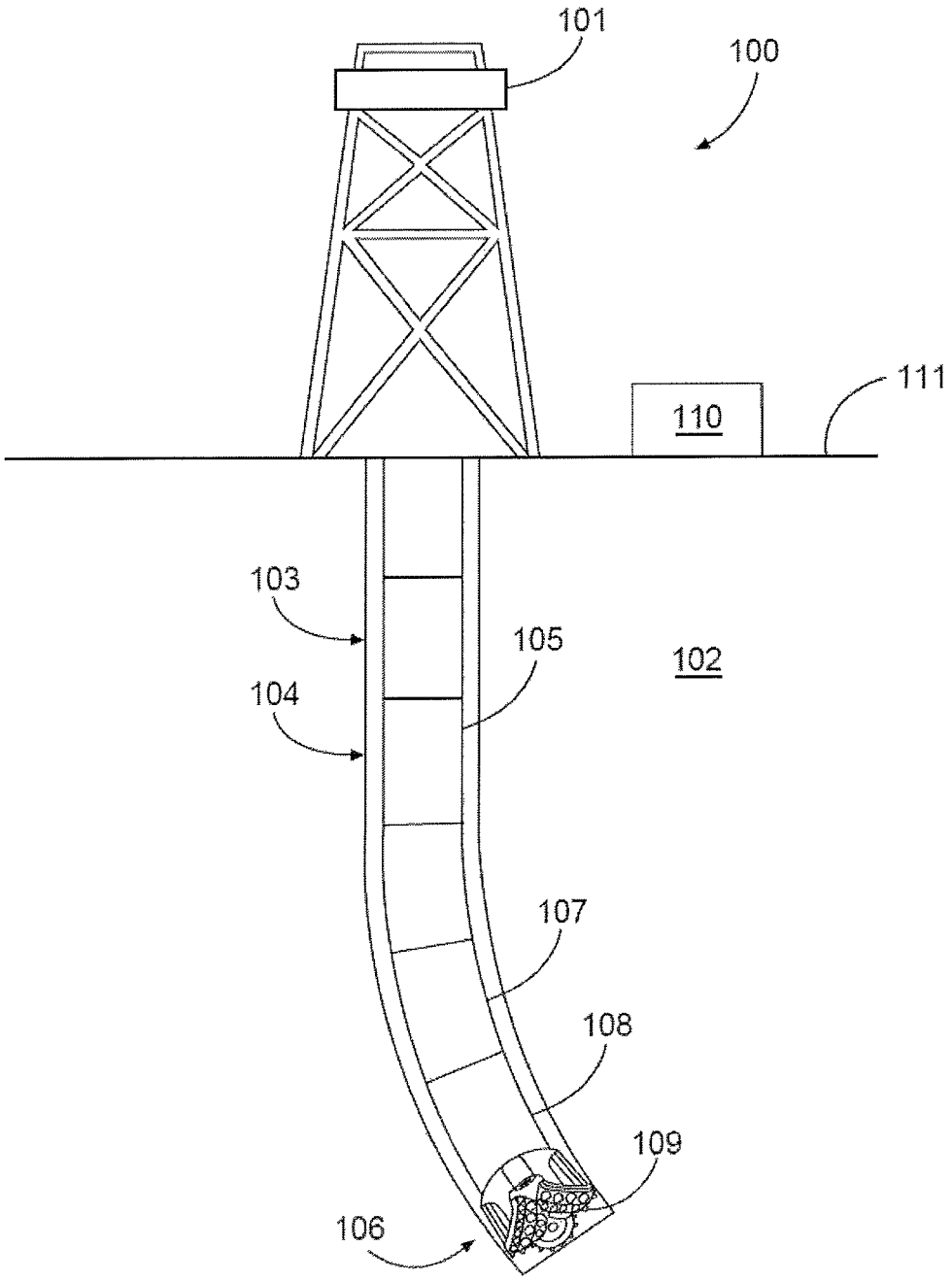
FIG. 1 illustrates an example drilling system, in accordance with embodiments of the present disclosure.

FIG. 1 illustrates an example drilling system 100, in accordance with embodiments of the present disclosure. The drilling system 100 includes a rig 101 located at a surface 111 and positioned above a wellbore 103 within a subterranean formation 102. In certain embodiments, a drilling assembly 104 may be coupled to the rig 101 using a drill string 105. The drilling assembly 104 may include a bottom hole assembly (BHA) 106. The BHA 106 may include a drill bit 109, a steering assembly 108, and a LWD/MWD apparatus 107. A control unit 110 located at the surface 111 may include a processor and memory device, and may communicate with elements of the BHA 106, in the LWD/MWD apparatus 107 and the steering assembly 108. In certain implementations, the control unit 110 may be an information handling system. The control unit 110 may receive data from and send control signals to the BHA 106. Additionally, at least one processor and memory device may be located downhole within the BHA 106 for the same purposes. The LWD/MWD apparatus 107 may log the formation 102 both while the wellbore 103 is being drilled. For example, LWD/MWD apparatus may log a trajectory of the wellbore 103, take periodic ranging measurements to determine a relative location of wellbore 113, or determine one or more characteristics of formation 102 (e.g., formation resistivity and/or type) during drilling operations. The steering assembly 108 may include a mud motor that provides power to the drill bit 109, and that is rotated along with the drill bit 109 during drilling operations. The mud motor may be a positive displacement drilling motor that uses the hydraulic power of the drilling fluid to drive the drill bit 109. In accordance with an exemplary embodiment of the present disclosure, the BHA 106 may include an optionally non-rotatable portion. The optionally non-rotatable portion of the BHA 106 may include any of the components of the BHA 106 excluding the mud motor and the drill bit 109. For instance, the optionally non-rotatable portion may include a drill collar, the LWD/MWD apparatus 107, bit sub, stabilizers, jarring devices and crossovers. In certain embodiments, the steering assembly 108 may angle the drill bit 109 to drill at an angle from the wellbore 103. Maintaining the axial position of the drill bit 109 relative to the wellbore 103 may require knowledge of the rotational position of the drill bit 109 relative to the wellbore 103.

Modifications, additions, or omissions may be made to FIG. 1 without departing from the scope of the present disclosure. For example, FIG. 1 illustrates components of drilling system 100 in a particular configuration. However, any suitable configuration of drilling components for drilling a hydrocarbon well may be used.

Figure 2:
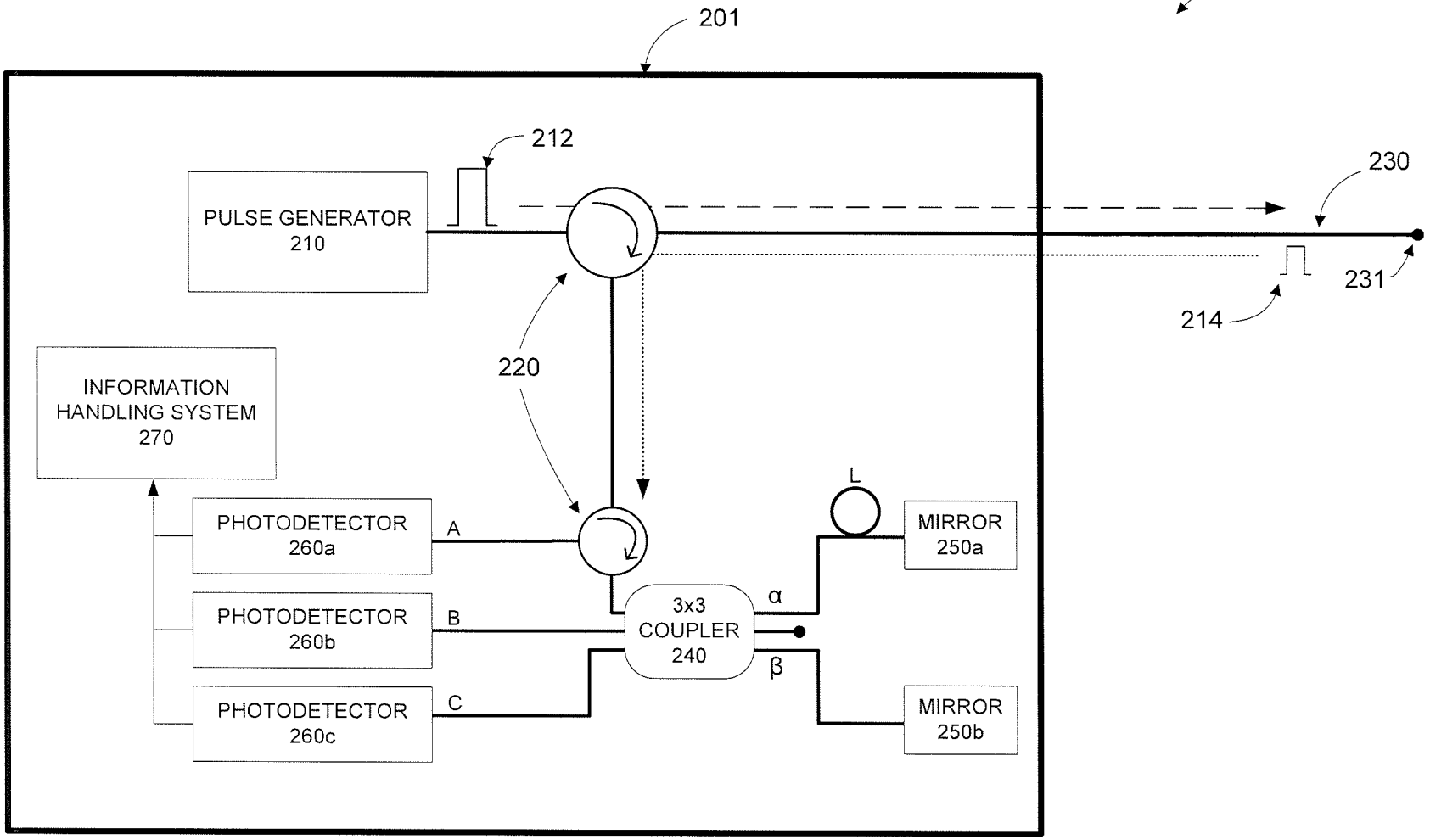
FIG. 2 illustrates an example DAS data collection system, in accordance with embodiments of the present disclosure.

FIG. 2 illustrates an example DAS data collection system 200, in accordance with embodiments of the present disclosure. DAS data collection system 200 may be used for measuring dynamic strain, acoustics, or vibration downhole in a drilling system such as drilling system 100 of FIG. 1. In particular, DAS data collection system 200 may be coupled to components of a drilling system similar to drilling system 100 in order to detect mud pulses and/or mud pump stroke pulses in the drilling system. For example, DAS system 200 may be coupled to a mud pump, a mud return tube, or a drill string of a drilling system as illustrated in FIG. 3 and described further below.

DAS data collection system 200 comprises DAS box 201 coupled to sensing fiber 230. DAS box 201 may be a physical container that comprises optical components suitable for performing DAS techniques using optical signals 212 transmitted through sensing fiber 230, including signal generator 210, circulators 220, coupler 240, mirrors 250, photodetectors 260, and information handling system 270 (all of which are communicably coupled with optical fiber), while sensing fiber 230 may be any suitable optical fiber for performing DAS techniques. DAS box 201 and sensing fiber 230 may be located at any suitable location for detecting mud pulses and/or mud pump stroke pulses. For example, in some embodiments, DAS box 201 may be located at the surface of the wellbore with sensing fiber 230 coupled to one or more components of the drilling system, such as a mud pump, a mud return tube, and a drill string.

Signal generator 210 may include a laser and associated opto-electronics for generating optical signals 212 that travel down sensing fiber 230. Signal generator 210 may be coupled one or more circulators 220 inside DAS box 201. In certain embodiments, optical signals 212 from signal generator 210 may be amplified using optical gain elements, such as any suitable amplification mechanisms including, but not limited to, Erbium Doped Fiber Amplifiers (EDFAs) or Semiconductor Optical Amplifiers (SOAs). Optical signals 212 may be highly coherent, narrow spectral line width interrogation light signals in particular embodiments.

As optical signals 212 travel down sensing fiber 230 as illustrated in FIG. 2, imperfections in the sensing fiber 230 may cause portions of the light to be backscattered along the sensing fiber 230 due to Rayleigh scattering. Scattered light according to Rayleigh scattering is returned from every point along the sensing fiber 230 along the length of the sensing fiber 230 and is shown as backscattered light 214 in FIG. 2. This backscatter effect may be referred to as Rayleigh backscatter. Density fluctuations in the sensing fiber 230 may give rise to energy loss due to the scattered light, with the following coefficient:

$$\alpha_{scat} = \frac{8\pi^3}{3\lambda^4} n^8 p^2 k T_f \beta$$

where n is the refraction index, p is the photoelastic coefficient of the sensing fiber 230, k is the Boltzmann constant, and β is the isothermal compressibility. $T_f$ is a fictive temperature, representing the temperature at which the density fluctuations are "frozen" in the material. In certain embodiments, sensing fiber 230 may be terminated with low reflection device 231. In some embodiments, the low reflection device may be a fiber coiled and tightly bent such that all the remaining energy leaks out of the fiber due to macrobending. In other embodiments, low reflection device 231 may be an angle cleaved fiber. In still other embodiments, the low reflection device 231 may be a coreless optical fiber. In still other embodiments, low reflection device 231 may be a termination, such as an AFL ENDLIGHT. In still other embodiments, sensing fiber 230 may be terminated in an index matching gel or liquid.

Backscattered light 214 may consist of an optical light wave or waves with a phase that is altered by changes to the optical path length at some location or locations along sensing fiber 230 caused by vibration or acoustically induced strain. By sensing the phase of the backscattered light signals, it is possible to quantify the vibration or acoustics along sensing fiber 230. An example method of detecting the phase the backscattered light is through the use of a 3×3 coupler, as illustrated in FIG. 2 as coupler 240. Backscattered light 214 travels through circulators 220 toward coupler 240, which may split backscattered light 214 among at least two paths (i.e., paths α and β in FIG. 2). One of the two paths may comprise an additional length L beyond the length of the other path. The split backscattered light 214 may travel down each of the two paths, and then be reflected by mirrors 250. Mirrors 250 may include any suitable optical reflection device, such as a Faraday rotator mirror. The reflected light from mirrors 250 may then be combined in coupler 240 and passed toward photodetectors 260*a-c*. The backscattered light signal at each of photodetectors 260*a-c* will contain the interfered light signals from the two paths (α and β), with each signal having a relative phase shift of 120 degrees from the others. The signals at photodetectors 260*a-c* may be passed to information handling system 270 for analysis. Information handling system 270 may be located at any suitable location, and may be located downhole, uphole (e.g., in control unit 110 of FIG. 1), or in a combination thereof. In particular embodiments, information handling system 270 may measure the interfered signals at photodetectors 260*a-c* having three different relative phase shifts of 0, +120, and −120 degrees, and accordingly determine the phase difference between the backscattered light signals along the two paths. This phase difference determined by information handling system 270 may be used to measure strain on sensing fiber 230 caused by vibrations in a formation. By sampling the signals at photodetectors 260*a-c* at a high sample rate, various regions along sensing fiber 230 may be sampled, with each region being the length of the path mismatch L between paths α and β.

The below equations may define the light signal received by photodetectors 260*a-c*:

$$a = k + P_\alpha \cos(2\pi ft) + P_\beta \cos(2\pi ft + \phi)$$

$$b = k + P_\alpha \cos(2\pi ft) + P_\beta \cos\left(2\pi ft + \phi + \frac{2\pi}{3}\right)$$

$$c = k + P_\alpha \cos(2\pi ft) + P_\beta \cos\left(2\pi ft + \phi - \frac{2\pi}{3}\right)$$

where α represents the signal at photodetector 260*a*, *b* represents the signal at photodetector 260*b*, *c* represents the signal at photodetector 260*c*, *f* represents the optical frequency of the light signal, ϕ=optical phase difference between the two light signals from the two arms of the interferometer, $P_\alpha$ and $P_\beta$ represent the optical power of the light signals along paths α and β, respectively, and k represents the optical power of non-interfering light signals received at the photodetectors (which may include noise from an amplifier and light with mismatched polarization which will not produce an interference signal).

In embodiments where photodetectors 260*a-c* are square law detectors with a bandwidth much lower than the optical frequency (e.g., less than 1 GHz), the signal obtained from the photodetectors may be approximated by the below equations:

$$A = \tfrac{1}{2}(2k^2 P_\alpha^2 + 2P_\alpha P_\beta \cos(\phi) + P_\beta^2)$$

$$B = \tfrac{1}{2}(2k^1 + P_\alpha^2 + P_\beta^2 - P_\alpha P_\beta(\cos(\phi) + \sqrt{3}\sin(\phi)))$$

$$C = \tfrac{1}{2}(2k^2 + P_\alpha^2 + P_\beta^2 + P_\alpha P_\beta(-\cos(\phi) + \sqrt{3}\sin(\phi)))$$

where A represents the approximated signal at photodetector 260*a*, B represents the approximated signal at photodetector 260*b*, and C represents the approximated signal at photodetector 260*c*. It will be understood by those of skill in the art that the terms in the above equations that contain ϕ are the terms that provide relevant information about the optical phase difference since the remaining terms involving the power (k, $P_\alpha$, and $P_\beta$) do not change as the optical phase changes.

In particular embodiments, quadrature processing may be used to determine the phase shift between the two signals. A quadrature signal may refer to a two-dimensional signal whose value at some instant in time can be specified by a single complex number having two parts: a real (or in-phase) part and an imaginary (or quadrature) part. Quadrature processing may refer to the use of the quadrature detected signals at photodetectors 260*a-c*. For example, a phase modulated signal y(t) with amplitude A, modulating phase signal θ(t), and constant carrier frequency f may be represented as:

$$y(t) = A\sin(2\pi ft + \theta(t))$$

Or $$y(t) = 1(t)\sin(2\pi ft) + Q(t)\cos(2\pi ft)$$

where $$I(t) \equiv A\cos(\theta(t)\cos(2\pi ft)$$

$$Q(t) \equiv A\sin(\theta(t))$$

Mixing the signal y(t) with a signal at the carrier frequency f results in a modulated signal at the baseband frequency and at 2f, wherein the baseband signal may be represented as follows:

$$y(t)e^{i\theta(t)} = I(t) + i^* Q(t)$$

Because the Q term is shifted by 90 degrees from the I term above, the Hilbert transform may be performed on the I term to get the Q term. Thus, where $\mathcal{H}(\cdot)$ represents the Hilbert transform:

$$Q(t) = \mathcal{H}(I(t))$$

The amplitude and phase of the signal may be represented by the following equations:

$$|y(t)| = \sqrt{I(t)^2 + Q(t)^2}$$

$$\theta(t) = \arctan\left(\frac{Q(t)}{I(t)}\right)$$

It will be understood by those of skill in the art that for signals A, B, and C above, the corresponding quadrature I and Q terms may be represented by the following equations:

$$I = A + B - 2C = \frac{3}{2}P_\alpha P_\beta(\cos(\phi) - \sqrt{3}\sin(\phi)) = 3P_\alpha P_\beta \cos\left(\phi + \frac{\pi}{3}\right)$$

$$Q = \sqrt{3}(A - B) = \frac{3}{2}P_\alpha P_\beta(\sqrt{3}\cos(\phi) + \sin(\phi)) = 3P_\alpha P_\beta \sin\left(\phi + \frac{\pi}{3}\right)$$

wherein the phase shift, which is shifted by π/3, is represented by:

$$\phi = \arctan\left(\frac{Q}{I}\right) - \frac{\pi}{3}$$

Accordingly, the phase of the backscattered light in sensing fiber 230 may be determined using the quadrature representations of the DAS data signals received at photodetectors 260. This allows for an elegant way to arrive at the phase using the quadrature signals inherent to the DAS data collection system.

Modifications, additions, or omissions may be made to FIG. 2 without departing from the scope of the present disclosure. For example, FIG. 2 shows a particular configuration of components of system 200. However, any suitable configuration of components configured to detect the optical phase and/or amplitude of coherent Rayleigh backscatter in optical fiber using spatial multiplexing (i.e., monitoring different locations, or channels, along the length of the fiber) may be used. For example, although optical signals 212 are illustrated as pulses, DAS data collection system 200 may transmit continuous wave optical signals 212 down sensing fiber 230 instead of, or in addition to, optical pulses. As another example, the measurement of acoustic disturbances in the optical fiber may be accomplished using fiber Bragg gratings embedded in the optical fiber. As yet another example, an interferometer may be placed in the launch path (i.e. in a position that splits and interferes optical signals 212 prior to traveling down sensing fiber 230) of the interrogating signal (i.e., the transmitted optical signal 212) to generate a pair of signals that travel down sensing fiber 230, as opposed to the use of an interferometer further downstream as shown in FIG. 2.

Figure 3A:
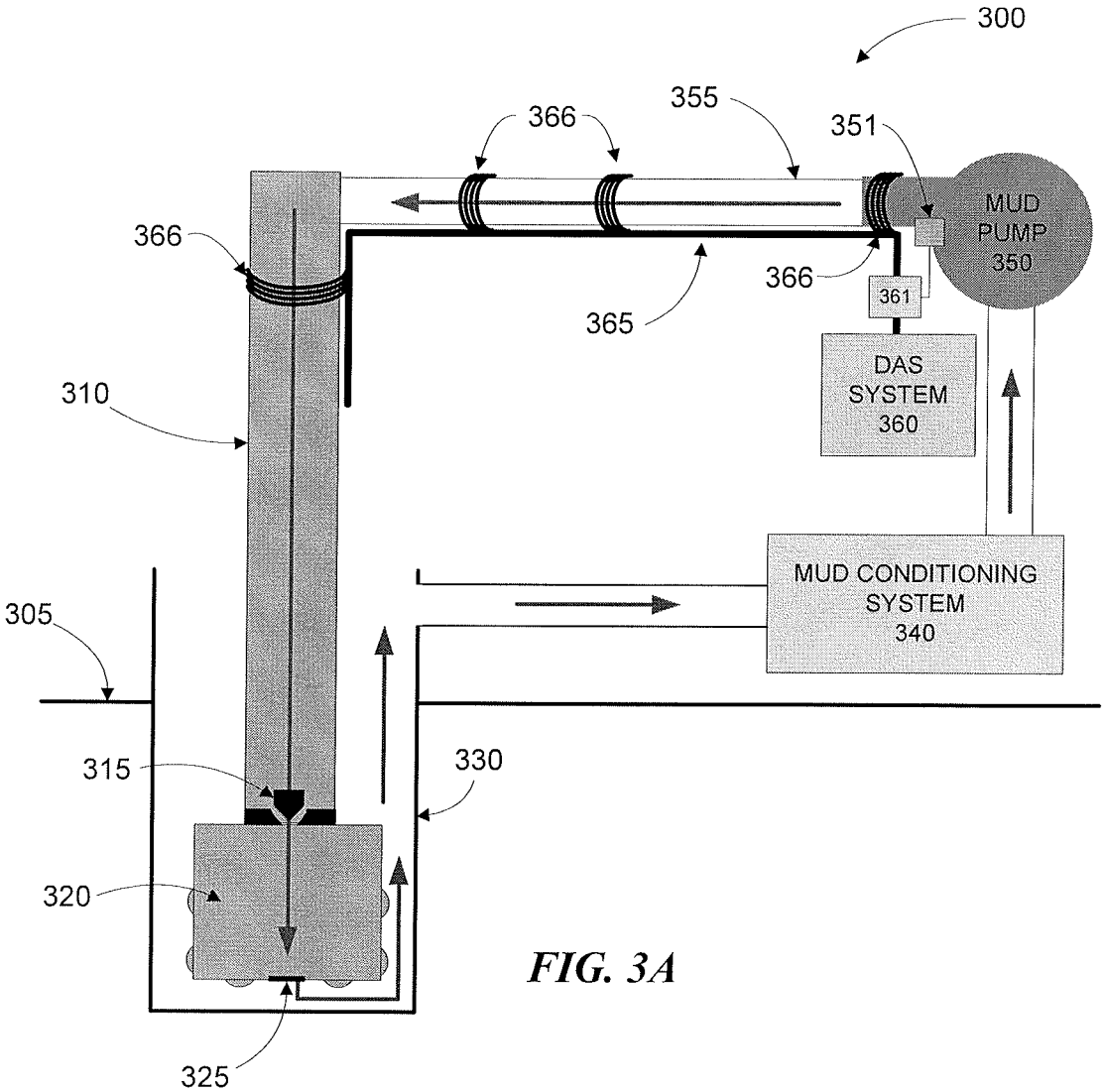
FIG. 3A illustrates an example mud pulse detection system for use in a downhole drilling system, in accordance with embodiments of the present disclosure.

FIG. 3A illustrates an example mud pulse detection system 300 for use in a downhole drilling system, in accordance with embodiments of the present disclosure. System 300 includes a drill string 310 coupled to drill bit 320 located below surface 305 inside wellbore 330. During drilling operations, drilling fluid known as "mud" may be pumped down drill string 310 and through valve 315 toward drill bit 320, as shown in FIG. 3A. Drill string 310 may comprise a valve 315 through which mud may flow toward drill bit 320. The mud may flow out of orifices 325 in drill bit 320 in order to provide lubrication and cooling for drill bit 320 as it cuts into the formation and to draw cuttings away from the bit-formation interface toward the surface. The mud may then be drawn out of wellbore 330 toward mud conditioning system 340, which may clean cuttings or other debris away from the mud and store the clean mud prior to being pumped back into drill string 310 by mud pump 350 for re-use as just described.

In particular embodiments, DAS system 360 and sensing fiber 365 (which may be similar to DAS box 201 and sensing fiber 230 of FIG. 2, respectively) may be used to detect and/or analyze mud pulses and/or mud pump stroke information in system 300. During drilling and while the mud flows through the system as described above, valve 315 may actuate (i.e., close or open, depending on the mud pulse configuration used (e.g., positive pulse vs. negative pulse)), generating pressure pulses that travel up drill string 310. The pressure pulses are positive changes in pressure for positive pulse embodiments, while the pressure pulses are negative changes in pressure for negative pulse embodiments. These pressure pulses (referred to as mud pulses) may be detected using DAS techniques as described herein. To detect the mud pulses, sensing fiber 365 may be coupled to one or more components of system 300 (such as mud pump 350, return tube 355, and/or drill string 310 as shown in FIG. 3A), allowing DAS system 360 to detect the acoustic disturbances in sensing fiber 365 caused by the mud pulses in the manner described above with respect to FIG. 2. The detected mud pulses may then be analyzed as described further below with respect to FIG. 5.

Figure 3B:
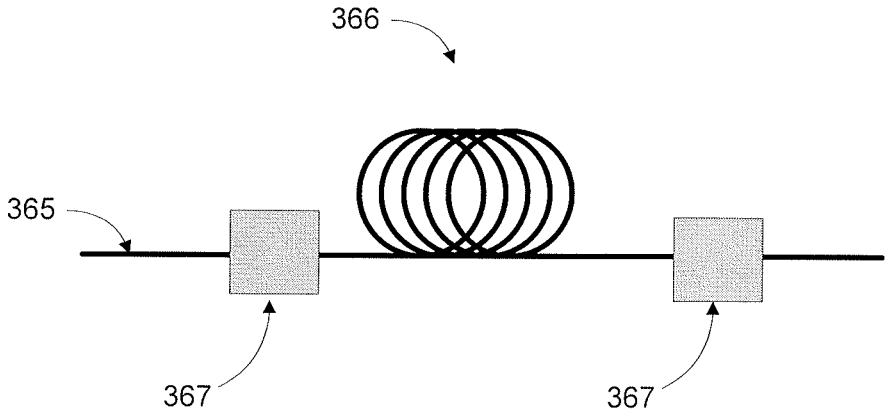
FIG. 3B illustrates an example sensing area of the mud pulse detection system of FIG. 3A, in accordance with embodiments of the present disclosure.

In particular embodiments, system 300 may include sensing areas 366. Sensing areas 366 may include portions of sensing fiber 365 wrapped around a portion of system 300 (e.g., return tube 355 or drill string 310) many times. FIG. 3B illustrates an example sensing area 366 of mud pulse detection system 300 of FIG. 3A, in accordance with embodiments of the present disclosure. For example, in embodiments where DAS channels are approximately one (1) meter apart, 100 meters of sensing fiber 365 may be wrapped or wound around a portion of return tube 355 to form a sensing area 366 that spans a few inches of return tube 355. Sensing areas 366 may accordingly comprise multiple channels of DAS data over a relatively close physical area of system 300, enhancing the signal-to-noise ratio (SNR) of the detected DAS data signals in sensing area 366. The enhanced SNR may be due to enhanced signals in the DAS data signal from acoustic disturbances being detected in multiple locations (channels) of sensing fiber 365. In addition, sensing areas 366 may allow for the averaging of the signals from each of the channels in the sensing area 366, improving the quality of the detected DAS data signal (i.e., SNR is increased by $\sqrt{N}$ where there are N channels in sensing area 366), since noise present in only a few of the channels of sensing area 366 will be reduced by the relatively noiseless channels in the sensing area 366 detecting the same acoustic disturbances in the same area of system 300. In some embodiments sensing area 366 may include reflectors 367 located at the ends of the wrapped sensing fiber 365, as shown in FIG. 3B, forming a Fizeau interferometer. Reflectors 367 may be any suitable low reflection optical device, such as a Bragg grating. The reflected signals from each reflector 367 will interfere with each other, allowing a measurement of phase difference between the two reflected signals. By measuring the phase of the reflected light from each reflector and subtracting these values, the differential phase between the two reflectors can be obtained which will contain the acoustic signal being measured.

In certain embodiments, sensing areas 366 may be used at multiple locations of system 300, as shown. Sensing fiber 365 may bend when wrapped to create sensing areas 366, causing reflections from the bend points. These reflections may have considerably higher magnitude than Rayleigh scattering from the same area. The reflections may thus destructively interfere with signals travelling in sensing fiber 365, resulting in null channels in the DAS data (i.e., channels with no data signal). Because the areas where bends occur in fiber 365 may change during operation (e.g., through physical movement of the components of system 300 during operation), the locations of the null channels may change during operation. Having multiple sensing areas 366 along the path of mud flow in system 300 may therefore allow for constant mud pulse sensing during operation.

In addition, in certain embodiments, DAS system 360 and sensing fiber 365 may be used to detect and/or analyze stroke pulses from mud pump 350. During drilling, mud pump 350 may generate additional pressure pulses in system 300 (referred to as stroke pulses or mud pump stroke information) when pumping mud back to drill string 310 through return tube 355. These stroke pulses may be caused, for example, by pistons or valves in mud pump 350. In particular embodiments, the stroke pulses may be detected by DAS system 360 through the use of a stroke sensor 351 coupled to mud pump 350 and a fiber disturber 361 coupled to sensing fiber 365. Fiber disturbers 361 may be any suitable means for encoding stroke pulse information into DAS data signals by causing acoustic or vibrational disturbances in sensing fiber 365 based on information sent by stroke sensor 351. For example, stroke sensor 351 may send information associated with detected stroke pulses to a piezo-electric fiber stretcher in fiber disturber 361. In certain embodiments, the mud pump stroke pulses may be detected by a sensing area 366 on or near mud pump 350. For example, sensing fiber 365 may be wrapped around one or more portions of mud pump 350 as shown in FIG. 3A. Example fiber disturbers 361 are illustrated in FIGS. 3C-3D.

Figure 3C:
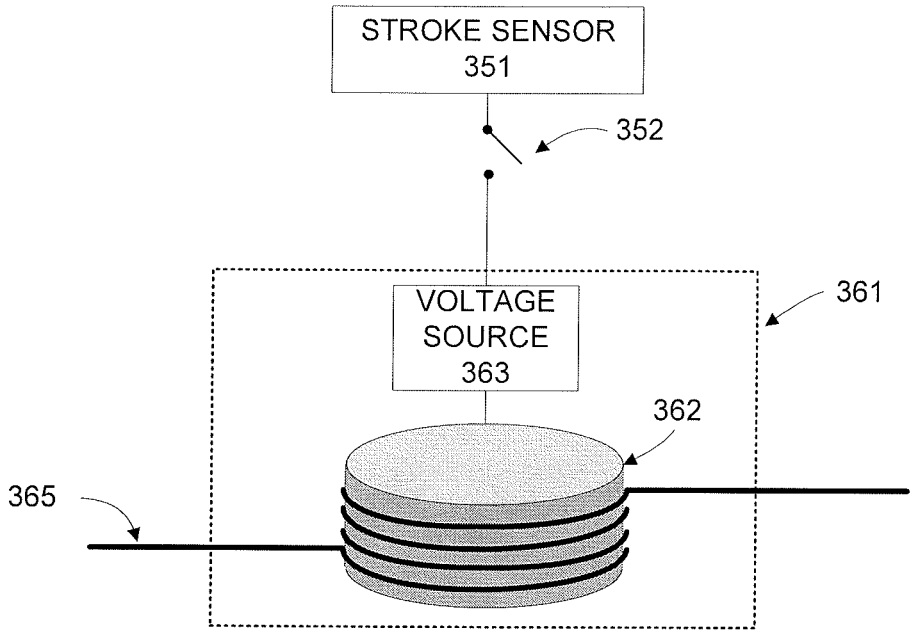
FIG. 3C illustrates an example fiber disturber of the mud pulse detection system of FIG. 3A comprising a fiber stretcher coupled to a voltage source, in accordance with embodiments of the present disclosure.

In particular, FIG. 3C illustrates an example fiber disturber 361 of mud pulse detection system 300 of FIG. 3A comprising a fiber stretcher 362 coupled to a voltage source 363, in accordance with embodiments of the present disclosure. A stroke sensor 351 coupled to mud pump 350 may be operable to detect mud pump strokes in mud pump 350 (i.e. what causes the stroke pulses) through any suitable means, such as through electro-mechanical sensors that detect the location of plungers in mud pump 350. The stroke sensor 351 may use switch 352 to convey information associated with the detected mud pump strokes to voltage source 363 for encoding stroke pulse information onto DAS data signals travelling in sensing fiber 365. For example, stroke sensor 351 may detect when plungers in mud pump 350 reach a particular position and may activate switch 352 at that time. The signals generated by switch 352 may switch an AC or DC voltage source 363 on and off to provide modulated electrical signals to a piezo-electric fiber stretcher 362, which may in turn stretch sensing fiber 365 based on the modulated electrical signals. The stretching of sensing fiber 365 may thus encode the mud pump stroke information sent by stroke sensor 351 (modulated by switch 352 and voltage source 363) by causing disturbances in sensing fiber 365 that may be detected by DAS system 360.

Figure 3D:
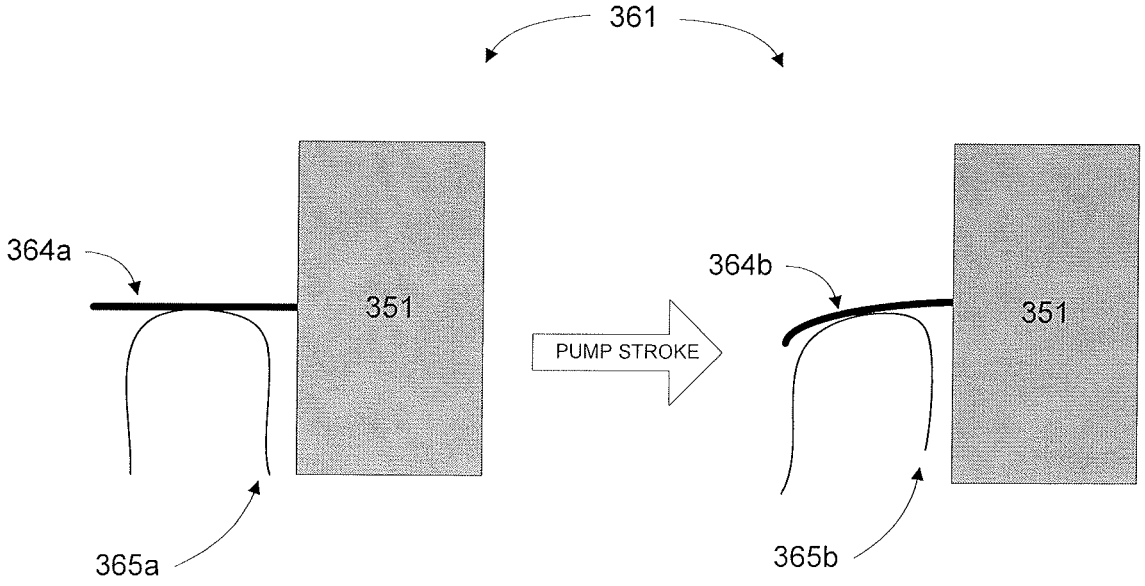
FIG. 3D illustrates an example fiber disturber of the mud pulse detection system of FIG. 3A comprising a cantilever coupled to a stroke sensor, with sensing fiber coupled to the cantilever, in accordance with embodiments of the present disclosure.

FIG. 3D illustrates an example fiber disturber 361 of mud pulse detection system 300 of FIG. 3A comprising a cantilever 364 coupled to stroke sensor 351, with sensing fiber 365 coupled to cantilever 364, in accordance with embodiments of the present disclosure. Cantilever 364 may be configured, in particular embodiments, such that it deforms when stroke sensor 351 detects a mud pump stroke from mud pump 350. As an example, cantilever 364 may be a piezo-electric device coupled to a voltage source (not pictured), similar to fiber stretcher 362 of FIG. 3B. Cantilever 364 may disturb sensing fiber 365 when mud pump strokes are detected by stroke sensor 351, causing stroke pulse information to be encoded onto DAS data signals travelling in sensing fiber 365. This stroke pulse information may then be detected by DAS system 360.

In certain embodiments, the mud pump stroke information may be encoded onto DAS data signals in sensing fiber 365 by creating a sensing area 366 on or near mud pump 350. For example, sensing fiber 365 may be wrapped around one or more portions of mud pump 350 to create a sensing area as shown in FIG. 3A.

Once the stroke pulse information has been encoded into the DAS data signals in sensing fiber 365, the stroke pulses may then be detected and then analyzed and/or processed along with the detected mud pulses. In some embodiments, this may include removing the detected stroke pulses from the received DAS signals to provide a clean mud pulse telemetry signal for analysis.

Furthermore, in certain embodiments, DAS system 360 and sensing fiber 365 may be used to analyze mud flow rates through return tube 355. By analyzing multiple channels in DAS system 360, the travel time of the mud pulses may be estimated using cross-correlation techniques (e.g., using matched filter operations, which may compensate for a non-flat noise floor unlike other cross-correlation methods). Because a distance between the DAS two channels is known, a pulse velocity (and thus mud flow velocity) may be readily determined using the determined travel time of the mud pulses. Moreover, by placing sensing areas 366 on different locations of return tube 355 may allow for the measurement of mud flow velocity at the different locations in system 300 (e.g., near where the mud returns from downhole and near where the mud returns to the drill string after conditioning). For example, sensing areas may be placed on return tube 355 between the drill string 310 and mud conditioning system 340 in addition to the locations illustrated in FIG. 3A to determine mud flow rates before and after entering mud conditioning system 340 and/or mud pump 350.

Modifications, additions, or omissions may be made to FIGS. 3A-3D without departing from the scope of the present disclosure. For example, FIG. 3A illustrates components of drilling system 300 in a particular configuration. However, any suitable configuration of drilling components for detecting mud pulses using DAS techniques may be used.

Figure 4:
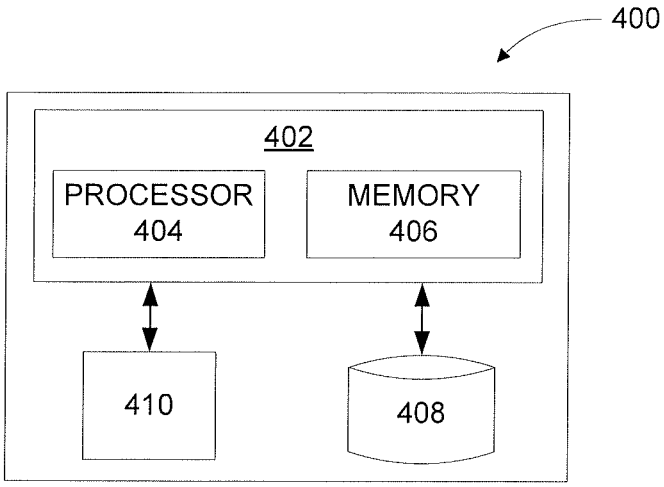
FIG. 4 illustrates a block diagram of an exemplary computing system for use with the drilling system of FIG. 1, the DAS data collection system of FIG. 2, or the mud pulse detection system of FIGS. 3A-3D, in accordance with embodiments of the present disclosure.

FIG. 4 illustrates a block diagram of an exemplary computing system 400 for use with drilling system 100 of FIG. 1, DAS data collection system 200 of FIG. 2, or mud pulse detection system 300 of FIG. 3A in accordance with embodiments of the present disclosure. Computing system 400 or components thereof can be located at the surface (e.g., in control unit 110 of FIG. 1), downhole (e.g., in BHA 106 and/or in LWD/MWD apparatus 107 of FIG. 1), or some combination of both locations (e.g., certain components may be disposed at the surface while certain other components may be disposed downhole, with the surface components being communicatively coupled to the downhole components).

Computing system 400 may be configured to detect mud pulses and mud pump stroke pulses in a downhole drilling system, in accordance with the teachings of the present disclosure. For example, computing system 400 may be configured to detect acoustic or vibrational signals (i.e., mud pump stroke information, caused by deliberate disturbances to the sensing fiber based on detected mud pump strokes) in received DAS data signals. In addition, computing system 400 may be configured to remove the mud pump stroke information from the DAS data signals to provide a cleaner signal for mud pulse signal analysis. In particular embodiments, computing system 400 may be used to perform one or more of the steps of the method described below with respect to FIG. 5.

In particular embodiments, computing system 400 may include pulse detection module 402. Pulse detection module 402 may include any suitable components. For example, in some embodiments, pulse detection module 402 may include processor 404. Processor 404 may include, for example a microprocessor, microcontroller, digital signal processor (DSP), application specific integrated circuit (ASIC), or any other digital or analog circuitry configured to interpret and/or execute program instructions and/or process data. In some embodiments, processor 404 may be communicatively coupled to memory 406. Processor 404 may be configured to interpret and/or execute program instructions or other data retrieved and stored in memory 406. Program instructions or other data may constitute portions of software 408 for carrying out one or more methods described herein. Memory 406 may include any system, device, or apparatus configured to hold and/or house one or more memory modules; for example, memory 406 may include read-only memory (ROM), random access memory (RAM), solid state memory, or disk-based memory. Each memory module may include any system, device or apparatus configured to retain program instructions and/or data for a period of time (e.g., computer-readable non-transitory media). For example, instructions from software 408 may be retrieved and stored in memory 406 for execution by processor 404.

In particular embodiments, pulse detection module 402 may be communicatively coupled to one or more displays 410 such that information processed by pulse detection module 402 may be conveyed to operators of drilling equipment. For example, pulse detection module 402 may convey information related to the detection of mud pulses (e.g., timing between the detected mud pulses) or mud pump stroke pulses to display 410.

Modifications, additions, or omissions may be made to FIG. 4 without departing from the scope of the present disclosure. For example, FIG. 4 shows a particular configuration of components of computing system 400. However, any suitable configurations of components may be used. For example, components of computing system 400 may be implemented either as physical or logical components. Furthermore, in some embodiments, functionality associated with components of computing system 400 may be implemented in special purpose circuits or components. In other embodiments, functionality associated with components of computing system 400 may be implemented in configurable general purpose circuit or components. For example, components of computing system 400 may be implemented by configured computer program instructions.

Figure 5:
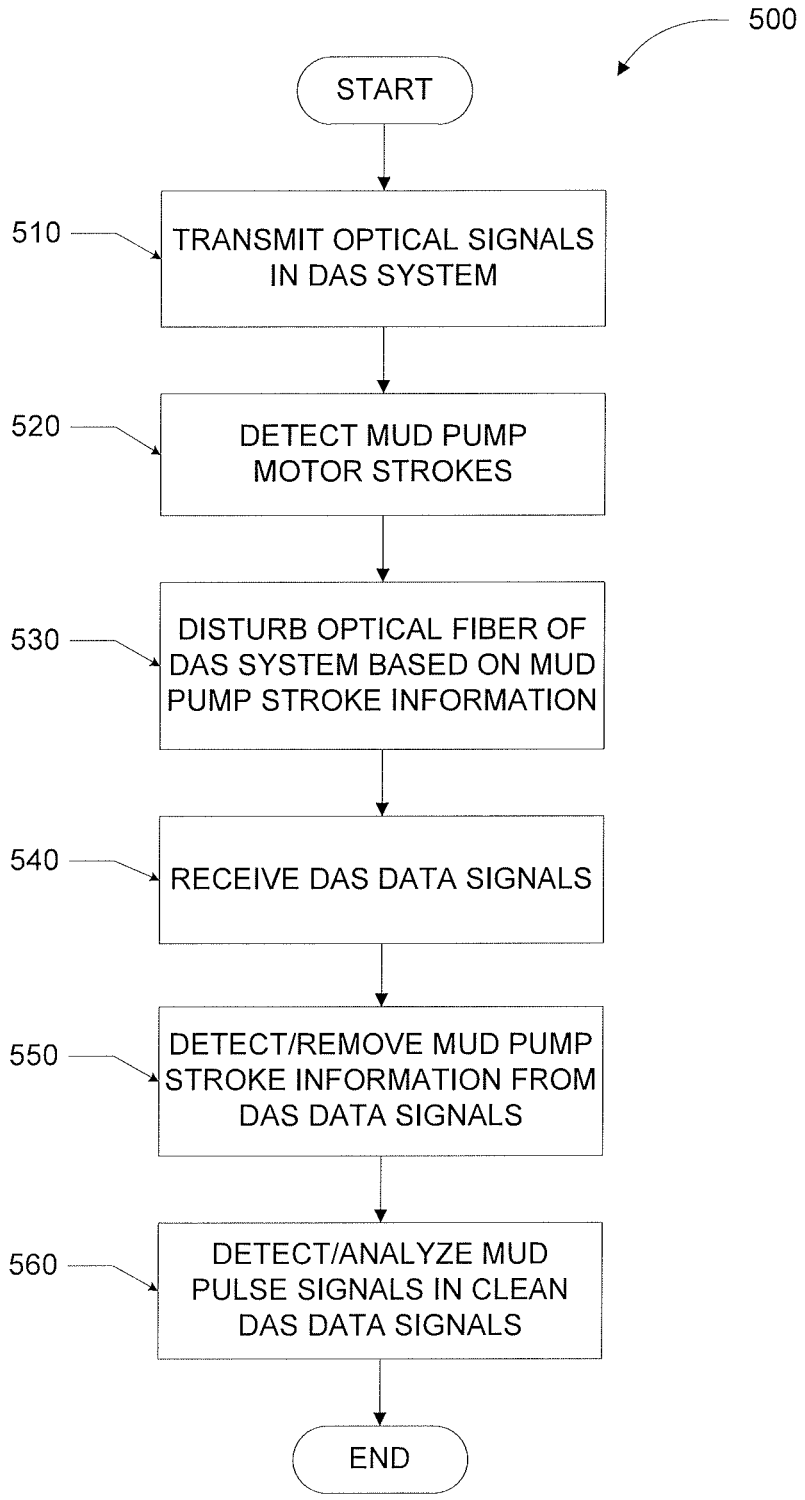
FIG. 5 illustrates an example method for detecting mud pump stroke pulses and mud pulses using DAS techniques in a downhole drilling system, in accordance with embodiments of the present disclosure.

FIG. 5 illustrates an example method 500 for detecting mud pump stroke pulses and mud pulses using DAS techniques in a downhole drilling system, in accordance with embodiments of the present disclosure. Method 500 may be performed using one or more computing systems, such as computing system 400 of FIG. 4, located in one or more components of a drilling system, such as drilling system 100 of FIG. 1. For example, method 500 may be performed by a computing system located in control unit 110 of FIG. 1, information handling system 270 of FIG. 2, DAS system 360 of FIG. 3A, or any combination thereof.

Method 500 begins at step 510, where optical pulses are transmitted in a DAS data collection system coupled to a downhole drilling system. The DAS data collection system may be similar to DAS data collection system 200 of FIG. 2 or DAS system 360 of FIG. 3A coupled to optical fiber 365. At step 520, mud pump motor strokes are detected. The mud pump motor strokes may be detected using any suitable means. For example, the mud pump motor strokes may be detected by a small electrical microswitch actuated by the displacement of a cantilever coupled to the mud pump, whereby the cantilever may be displaced by movements in the mud pump (e.g., mud pump pistons or plungers). The microswitch may then generate an electrical signal comprising the mud pump stroke information based on the actuation of the cantilever by the mud pump.

At step 530, the optical fiber of the DAS system is disturbed based on the mud pump stroke information detected at step 520. The disturbances in the optical fiber of DAS system may thus encode the mud pump stroke information into DAS data signals received by the DAS system. This encoding may be through any suitable means, such as through the use of a fiber stretcher (e.g., fiber stretcher 362 of FIG. 3C) or the use of a cantilever (e.g., cantilever 364 of FIG. 3D). In particular embodiments, the mud pump stroke information may be directly encoded onto the optical fiber by the cantilever coupled to the mud pump as described above. In certain embodiments, a sensing area (e.g., sensing area 366 of FIGS. 3A-3B) may be created on the mud pump such that the acoustic disturbances caused by the mud pump are directly encoded into the DAS data signals without the use of a separate device (e.g., a fiber stretcher). In such embodiments, step 520 may be effectively bypassed.

At step 540, DAS data signals are received by the DAS system. The DAS data signals may be received from a DAS data collection system (similar to system 200 of FIG. 2) coupled to a portion of a downhole drilling system (as described above with respect to FIG. 3A). For example, fiber optic cable coupled to DAS data collection system may be coupled to a mud pump, to a mud return tube connected thereto, and/or to the drill string of the downhole drilling system. The received DAS data signals may be in quadrature form, as described above.

At step 550, the mud pump stroke information encoded into the DAS data signals at step 530 is detected and removed. This may be done, for example, by cross-correlating the received DAS data signals with the mud pump information signal detected by the stroke sensor in step 510. For example, a matched filter operation may be performed using the received DAS signals and the mud pump stroke information. This may also be done by subtracting the signal generated by the stroke sensor in step 520 from the received DAS data signals. However, any suitable noise cancellation technique may be used to remove the encoded mud pump stroke information.

At step 560, the mud pulse signals are detected and/or analyzed in the cleaned DAS data signal (i.e., the DAS data signal with the mud pump stroke information removed therefrom). This may be performed through any suitable means. For example, cross-correlation may be performed on the clean DAS data signal using a template signal chosen to closely represent the expected mud pulse signals. For example, a matched filter operation may be performed on the clean DAS data using a decaying sinusoidal signal that closely resembles the expected mud pulse signals in the data. In certain embodiments, the cross-correlation may be performed using the quadrature signals received by the DAS system, without having to transform the signals into phase data signals. In such embodiments, the template signal may be first transformed into an analytical representation (e.g., through the Hilbert transform) such that it may be used in cross-correlation with the quadrature DAS data signals.

Modifications, additions, or omissions may be made to method 500 without departing from the scope of the present disclosure. For example, the order of the steps may be performed in a different manner than that described and some steps may be performed at the same time. Additionally, each individual step may include additional steps without departing from the scope of the present disclosure.

To provide illustrations of one or more embodiments of the present disclosure, the following examples are provided.

In one embodiment, a system for detecting mud pump stroke information comprises a distributed acoustic sensing (DAS) data collection system coupled to a downhole drilling system, a stroke detector coupled to a mud pump of the downhole drilling system configured to detect strokes in the mud pump and to generate mud pump stroke information based on the detected strokes, and a fiber disturber coupled to the stroke detector and to optical fiber of the DAS data collection system configured to disturb the optical fiber of the DAS data collection system based on mud pump stroke information generated by the stroke detector. The system further comprises a computing system comprising a processor, memory, and a pulse detection module operable to transmit optical pulses into the optical fiber of the DAS data collection system, receive DAS data signals in response to the transmitted optical pulses, and detect mud pump stroke information in the received DAS data signals.

In one or more aspects of the disclosed system, the pulse detection module is further operable to apply a matched filter operation to the received DAS data signals.

In one or more aspects of the disclosed system, the pulse detection module operable to detect mud pump stroke information in the received DAS data signals is further operable to cross-correlate the received DAS data signals with the mud pump stroke information generated by the stroke detector.

In one or more aspects of the disclosed system, the pulse detection module is further operable to remove the detected mud pump stroke information from the received DAS data signals to yield a clean DAS data signal.

In one or more aspects of the disclosed system, the pulse detection module is further operable to detect mud pulse signals in the clean DAS data signals.

In one or more aspects of the disclosed system, the pulse detection module operable to detect mud pulse signals in the received DAS data signals is further operable to cross-correlate the clean DAS data signals with a template signal.

In one or more aspects of the disclosed system, the pulse detection module operable to detect mud pulse signals in the received DAS data signals is further operable to apply a matched filter operation to the clean DAS data signals using a template signal.

In one or more aspects of the disclosed system, the fiber disturber comprises a fiber stretcher.

In one or more aspects of the disclosed system, the fiber disturber comprises a cantilever.

In one or more aspects of the disclosed system, the optical fiber of the DAS data collection system comprises a plurality of sensing areas, each sensing area including at least one winding of optical fiber.

In one or more aspects of the disclosed system, the optical fiber of the DAS data collection system comprises a plurality of sensing areas, each sensing area including reflectors on each side of the sensing area.

In one or more aspects of the disclosed system, the optical fiber of the DAS data collection system comprises a sensing area coupled to a mud return tube of the downhole drilling system.

In one or more aspects of the disclosed system, the optical fiber of the DAS data collection system comprises a sensing area coupled to a drill string of the downhole drilling system.

In one or more aspects of the disclosed system, the optical fiber of the DAS data collection system comprises a sensing area coupled to the mud pump of the downhole drilling system.

In another embodiment, a method for detecting mud pump stroke information comprises transmitting optical pulses into optical fiber of a distributed acoustic sensing (DAS) data collection system coupled to a downhole drilling system, detecting strokes in a mud pump coupled to the downhole drilling system, generating mud pump stroke information based on the detected strokes, disturbing the optical fiber of the DAS data collection system based on the generated mud pump stroke information, receiving DAS data signals in response to the transmitted the optical pulses, and detecting mud pump stroke information in the received DAS data signals.

In one or more aspects of the disclosed method, the method further comprises applying a matched filter operation to the received DAS data signals.

In one or more aspects of the disclosed method, detecting mud pump stroke information in the received DAS data signals further comprises cross-correlating the received DAS data signals with the mud pump stroke information generated by the stroke detector.

In one or more aspects of the disclosed method, the method further comprises removing the detected mud pump stroke information from the received DAS data signals to yield a clean DAS data signal.

In one or more aspects of the disclosed method, the method further comprises detecting mud pulse signals in the clean DAS data signals.

In one or more aspects of the disclosed method, detecting mud pulse signals in the received DAS data signals further comprises cross-correlating the clean DAS data signals with a template signal.

In one or more aspects of the disclosed method, detecting mud pulse signals in the received DAS data signals further comprises applying a matched filter operation to the clean DAS data signals using a template signal.

In one or more aspects of the disclosed method, the fiber disturber comprises a fiber stretcher.

In one or more aspects of the disclosed method, the fiber disturber comprises a cantilever.

In one or more aspects of the disclosed method, the optical fiber of the DAS data collection system comprises a plurality of sensing areas, each sensing area including at least one winding of optical fiber.

In one or more aspects of the disclosed method, the optical fiber of the DAS data collection system comprises a plurality of sensing areas, each sensing area including reflectors on each side of the sensing area.

In one or more aspects of the disclosed method, the optical fiber of the DAS data collection system comprises a sensing area coupled to a mud return tube of the downhole drilling system.

In one or more aspects of the disclosed method, the optical fiber of the DAS data collection system comprises a sensing area coupled to a drill string of the downhole drilling system.

In one or more aspects of the disclosed method, the optical fiber of the DAS data collection system comprises a sensing area coupled to the mud pump of the downhole drilling system.

Illustrative embodiments of the present disclosure are described in detail herein. In the interest of clarity, not all features of an actual implementation may be described in this specification. It will of course be appreciated that in the development of any such actual embodiment, numerous implementation-specific decisions may be made to achieve the specific implementation goals, which may vary from one implementation to another. Moreover, it will be appreciated that such a development effort might be complex and time-consuming, but would nevertheless be a routine undertaking for those of ordinary skill in the art having the benefit of the present disclosure.

The terms "couple" or "couples" as used herein are intended to mean either an indirect or a direct connection. Thus, if a first device couples to a second device, that connection may be through a direct connection, or through an indirect electrical or mechanical connection via other devices and connections. The term "upstream" as used herein means along a flow path towards the source of the flow, and the term "downstream" as used herein means along a flow path away from the source of the flow. The term "uphole" as used herein means along the drill string or the hole from the distal end towards the surface, and "downhole" as used herein means along the drill string or the hole from the surface towards the distal end.

The present disclosure is therefore well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. Also, the terms in the claims have their plain, ordinary meaning unless otherwise explicitly and clearly defined by the patentee.

What is claimed is:

1. A system for detecting mud pump stroke information, comprising:

a distributed acoustic sensing (DAS) data collection system coupled to a downhole drilling system;

a stroke detector coupled to a mud pump of the downhole drilling system, the stroke detector configured to detect strokes in the mud pump and to generate mud pump stroke information based on the detected strokes, wherein the stroke detector comprises:

a stroke sensor coupled to the mud pump; and a fiber disturber coupled to an optical fiber of the DAS data collection system, wherein the fiber disturber encodes the mud pump stroke information into DAS data signals by causing disturbances in the optical fiber of the DAS data collection system based on a mud pump information sensed by the stroke sensor; and a computing system comprising a processor, a memory, and a pulse detection module, the pulse detection module operable to:

transmit optical signals into the optical fiber of the DAS data collection system;

receive the DAS data signals in response to the transmitted optical signals; and detect the mud pump stroke information encoded in the received DAS data signals.

2. The system of claim 1, wherein the pulse detection module is further operable to apply a matched filter operation to the received DAS data signals.

3. The system of claim 1, wherein the pulse detection module operable to detect mud pump stroke information in the received DAS data signals is further operable to cross-correlate the received DAS data signals with the mud pump stroke information generated by the stroke detector.

4. The system of claim 1, wherein the pulse detection module is further operable to remove the detected mud pump stroke information from the received DAS data signals to yield a clean DAS data signal.

5. The system of claim 4, wherein the pulse detection module is further operable to detect mud pulse signals in the clean DAS data signals.

6. The system of claim 5, wherein the pulse detection module operable to detect mud pulse signals in the received DAS data signals is further operable to cross-correlate the clean DAS data signals with a template signal.

7. The system of claim 6, wherein the pulse detection module operable to detect mud pulse signals in the received DAS data signals is further operable to apply a matched filter operation to the clean DAS data signals using a template signal.

8. The system of claim 1, wherein the fiber disturber comprises a fiber stretcher.

9. The system of claim 1, wherein the fiber disturber comprises a cantilever.

10. The system of claim 1, wherein the optical fiber of the DAS data collection system comprises at least one of: a plurality of sensing areas, each sensing area including at least one winding of optical fiber, a plurality of sensing areas, each sensing area including reflectors on each side of the sensing area, a sensing area coupled to a mud return tube of the downhole drilling system, a sensing area coupled to a drill string of the downhole drilling system, and a sensing area coupled to the mud pump of the downhole drilling system.

11. A method for detecting mud pump stroke information, comprising:

transmitting optical signals into optical fiber of a distributed acoustic sensing (DAS) data collection system coupled to a downhole drilling system;

detecting, by a stroke detector, strokes in a mud pump coupled to the downhole drilling system, wherein the stroke detector comprises:

a stroke sensor coupled to the mud pump; and a fiber disturber coupled to an optical fiber of the DAS data collection system;

generating mud pump stroke information based on the detected strokes, wherein generating the mud pump stroke information comprises:

sensing, by the stroke sensor, a mud pump information associated with the mud pump;

causing, by the fiber disturber, disturbances in the optical fiber of the DAS data collection system based on the mud pump information sensed by the stroke sensor; and encoding, by the fiber disturber, the mud pump stroke information into DAS data signals based on the disturbances;

receiving the DAS data signals in response to the transmitted the optical signals; and detecting mud pump stroke information encoded in the received DAS data signals.

12. The method of claim 11, further comprising applying a matched filter operation to the received DAS data signals.

13. The method of claim 11, wherein detecting mud pump stroke information in the received DAS data signals further comprises cross-correlating the received DAS data signals with the mud pump stroke information generated by the stroke detector.

14. The method of claim 11, further comprising removing the detected mud pump stroke information from the received DAS data signals to yield a clean DAS data signal.

15. The method of claim 14, further comprising detecting mud pulse signals in the clean DAS data signals.

16. The method of claim 15, wherein detecting mud pulse signals in the received DAS data signals further comprises cross-correlating the clean DAS data signals with a template signal.

17. The method of claim 15, wherein detecting mud pulse signals in the received DAS data signals further comprises applying a matched filter operation to the clean DAS data signals using a template signal.

18. The method of claim 11, wherein the fiber disturber comprises a fiber stretcher.

19. The method of claim 11, wherein the fiber disturber comprises a cantilever.

20. The method of claim 11, wherein the optical fiber of the DAS data collection system comprises at least one of: a plurality of sensing areas, each sensing area including at least one winding of optical fiber, a plurality of sensing areas, each sensing area including reflectors on each side of the sensing area, a sensing area coupled to a mud return tube of the downhole drilling system, a sensing area coupled to a drill string of the downhole drilling system, and a sensing area coupled to the mud pump of the downhole drilling system.

* * * * *